US009393584B2

(12) United States Patent
Lecoutre et al.

(10) Patent No.: US 9,393,584 B2
(45) Date of Patent: Jul. 19, 2016

(54) FLUID APPLICATOR DEVICE

(71) Applicant: APTAR FRANCE SAS, Le Neubourg (FR)

(72) Inventors: Jean-Paul Lecoutre, Conde sur Iton (FR); Celine Raphanel, Pullay (FR)

(73) Assignee: APTAR FRANCE SAS, Le Neubourg (FR)

( * ) Notice: Subject to any disclaimer, the term of this patent is extended or adjusted under 35 U.S.C. 154(b) by 223 days.

(21) Appl. No.: 14/105,351

(22) Filed: Dec. 13, 2013

(65) Prior Publication Data

US 2014/0169857 A1 Jun. 19, 2014

Related U.S. Application Data

(60) Provisional application No. 61/756,859, filed on Jan. 25, 2013.

(30) Foreign Application Priority Data

Dec. 14, 2012 (FR) ..... 12 62055

(51) Int. Cl.

| | |
|---|---|
| ***A46B 11/00*** | (2006.01) |
| ***B05C 1/00*** | (2006.01) |
| ***A45D 40/26*** | (2006.01) |
| ***A45D 34/04*** | (2006.01) |
| ***B65D 51/32*** | (2006.01) |

(52) U.S. Cl.

CPC ..... *B05C 1/00* (2013.01); *A45D 34/046* (2013.01); *A45D 40/267* (2013.01); *B65D 51/32* (2013.01)

(58) Field of Classification Search

CPC ..... A45D 34/046; A45D 40/267
USPC ..... 401/121–122, 126–130; 132/218
See application file for complete search history.

(56) References Cited

U.S. PATENT DOCUMENTS

| | | | | |
|---|---|---|---|---|
| 4,175,574 | A | 11/1979 | Zulberti | |
| 4,609,300 | A * | 9/1986 | Robert | B65D 51/32 132/218 |
| 7,695,209 | B2 * | 4/2010 | Perignon | B65D 51/32 401/126 |
| 8,684,615 | B2 * | 4/2014 | Lecoutre | A45D 40/267 132/218 |
| 2011/0129287 | A1 | 6/2011 | Lecoutre | |

FOREIGN PATENT DOCUMENTS

| | | | |
|---|---|---|---|
| FR | 2 285 101 | A | 4/1976 |
| FR | 2 390 917 | A1 | 12/1978 |
| FR | 2 933 961 | A1 | 1/2010 |
| JP | 09-215521 | A | 8/1997 |
| WO | 2005/105598 | A1 | 11/2005 |
| WO | 2010/007301 | A1 | 1/2010 |

* cited by examiner

*Primary Examiner* — Jennifer C Chiang
(74) *Attorney, Agent, or Firm* — Sughrue Mion, PLLC

(57) ABSTRACT

A fluid applicator device comprises a reservoir and a stopper including a fastener collar and a closure member, the fastener collar being assembled on the neck and defining an orifice, the closure member being capable of closing the orifice and includes a fluid extractor and/or applicator element that extends along an axis through the orifice and into the reservoir. The fastener collar comprises an annular flange defining a peripheral edge defining the orifice, the annular flange including an inner flange wall and an outer flange wall that join together at the peripheral edge, the outer flange wall forming an outer dome having a top where the peripheral edge and the orifice are formed, the inner flange wall forming an inner dome having a top where the peripheral edge and the orifice are formed.

17 Claims, 3 Drawing Sheets

FLUID APPLICATOR DEVICE

CROSS REFERENCE TO RELATED APPLICATION

This application claims the benefit under 35 U.S.C. §119 (e) of pending U.S. provisional patent application Ser. No. 61/756,859, filed Jan. 25, 2013, and priority under 35 U.S.C. §119(a)-(d) of French patent application No. FR-12.62055, filed Dec. 14, 2012.

TECHNICAL FIELD

The present invention relates to a fluid applicator device comprising: a fluid reservoir; a fastener collar that is assembled on the reservoir; and a closure member that is capable of closing an orifice that is formed by the collar, the closure member including an extractor and applicator element that extends through the orifice of the collar and into the reservoir. Advantageous fields of application of the present invention are the fields of cosmetics, perfumery, or even pharmacy. However, other technical fields may be concerned.

BACKGROUND OF THE INVENTION

In the prior art, document WO 2005/105598 describes an applicator device that is more particularly for the specific field of perfume samples. The reservoir is in the form of a small bottle, e.g. made of glass, including a neck defining an inner wall defining an opening that puts the inside of the reservoir into communication with the outside. The applicator device of that document also includes a fastener collar, e.g. made of plastics material, that is assembled in sealed manner on the neck of the reservoir. The collar defines an orifice through which the closure member extends. The closure member comprises: a handle by means of which the user may hold the closure member; and a fluid extractor and applicator element that extends through the orifice of the collar and into the reservoir. The free end of the extractor element is dipped in the fluid stored in the reservoir. Thus, the extractor element makes it possible to extract fluid from the reservoir. The closure member may be removed from the fastener collar by pulling the extractor element out of the reservoir, through the orifice of the collar. Then, the user may apply the fluid on the extractor element to the desired application surface. When the fluid is a perfume, the applicator element may be merely in the form of a small stem of plastics material on which a small quantity of perfume may become attached. The extractor element may be in other shapes that make it possible to extract more fluid.

However, in certain kinds of application, it is necessary for the quantity of extracted fluid to be sufficient, but not excessive. In addition, it may also be important to distribute the fluid in uniform manner over a certain length of the extractor element. In other kinds of application, it suffices to avoid any risk of fluid droplets being lost once the extractor element has been removed from its reservoir. The various problems are solved by the applicator device of document FR 2 933 961 which describes an applicator device similar to the applicator device of document WO 2005/105598, but that is further provided with wiper means for wiping the extractor and/or applicator element while it is being removed from the reservoir. The wiper means may comprise a plurality of tabs that are movable radially inwards towards the extractor and applicator element by contact with the neck. The tabs define top junction ends and bottom free ends, the free ends being movable radially inwards by means of the tabs pivoting about the junction ends. Each tab includes an outer cam profile in the proximity of its junction end, the cam profile coming into engagement with the inner wall of the neck so as to cause the free end of the tab to pivot inwards. The free ends of the tabs are separated from one another by slots in their initial position, and are substantially touching in their final position, so as to co-operate with one another to define a wiper ring.

The above-mentioned prior-art applicator devices make it possible to apply fluid only by means of the extractor and/or applicator element. In addition, Repositioning the closure member in the fastener collar is not satisfactory, in particular at its snap-fastening, because of a sealing fault as a result of the irregular profile of the snap-fastener edge that results from the bridge of material that initially connects the closure member to the collar being broken.

BRIEF SUMMARY OF THE INVENTION

To achieve the various objects, the present invention proposes a fluid applicator device, comprising:

- a fluid reservoir including a neck defining an inner wall defining an opening; and
- a stopper comprising a fastener collar and a closure member;
- the fastener collar being assembled in sealed manner on the neck of the reservoir, the fastener collar defining an orifice; and
- the closure member being capable of closing the orifice of the collar, the closure member including a fluid extractor and/or applicator element that extends along an axis X through the orifice of the collar and into the reservoir;

wherein the fastener collar comprises a top portion forming an annular flange defining a peripheral edge defining the orifice, the annular flange including an inner flange wall and an outer flange wall that join together at the peripheral edge, the outer flange wall forming an outer dome having a top where the peripheral edge and the orifice are formed, the inner flange wall forms an inner dome having a top where the peripheral edge and the orifice are formed.

By means of the outer dome, the fluid applicator device may be used by bringing it into contact with an application surface, such as the skin. It suffices for the user to turn the reservoir (provided with its collar) upsidedown, so as to bring the fluid to the level of the orifice. The dome shape makes contact with the application surface easier, and intuitively informs the user of its applicator function. The outer dome, that is preferably rounded and convex, resembles a rotary roll-on ball, or even a lipstick, such that the user users it as an applicator without even needing to be informed.

According to a characteristic of the invention, the orifice presents a minimum diameter.

Advantageously, the inner flange wall forms an inner dome, preferably rounded and concave, having a top where the peripheral edge and the orifice are formed. This particular configuration for the inner dome makes it easier for the fluid to flow towards the reservoir when the user returns the reservoir to its normal upright position. The fluid does not encounter any profile where it becomes attached by capillary retention, given that the inner flange wall widens immediately below the orifice. Alternatively, the inner dome is staged.

The flange that forms the outer and inner domes also forms the snap-fastener edge that defines the orifice. According to a characteristic of the invention, the closure member includes a snap-fastener housing that is capable of receiving, in removable manner, the peripheral edge, so as to close the orifice of the collar. In an advantageous aspect, the snap-fastener housing comprises a snap-fastener profile that projects radially outwards, a radial abutment wall, and a reception space that is arranged between the snap-fastener profile and the radial abutment wall, the peripheral edge being received in removable manner in the reception space, with the inner flange wall in contact with the snap-fastener profile and the outer flange wall in contact with the radial abutment wall. Advantageously, the radial abutment wall forms an annular sealing rim against which the outer flange wall comes into sealing contact, when the peripheral edge is received in the reception space. In a practical embodiment, the snap-fastener profile may comprise an outer section, an inner section, and a snap-fastener bead that projects between the outer and inner sections, the outer section connecting the snap-fastener bead to a substantially cylindrical section, the reception space presenting a diameter that is greater than the diameter of the substantially cylindrical section. Preferably, the outer section is in the form of a ramp forming an angle of less than 45° relative to the axis X.

According to another characteristic of the invention, the peripheral edge of the collar is initially connected via a bridge of material to a junction zone of the extractor and/or applicator element. As a result, the orifice does not exist before the applicator device is used for the first time: it results from breaking the bridge of material. But since breaking is difficult to control, the profile of the edge is irregular. The advantage of the snap-fastening of the present invention resides in the fact that the edge is received in the snap-fastener space but does not participate either in fastening or in sealing. Preferably, the peripheral edge of the collar is initially connected via a bridge of material to a junction zone of the extractor and/or applicator element, which junction zone is formed at the substantially cylindrical section, just above a frustoconical section. Thus, the inner dome is immediately spaced apart from the extractor and/or applicator element, given that they extend in diverging manner. The fluid thus does not have the possibility of being retained by capillarity.

In another advantageous aspect of the invention, the collar has wiper means formed integrally therewith for wiping the extractor and/or applicator element while it is being removed from the reservoir. Advantageously, the collar includes a sealing skirt that is capable of coming into sealing contact with the inner wall of the neck, the wiper means being formed integrally to extend the skirt. The wiper means serve not only to wipe the extractor and/or applicator element, but also to reduce the passage towards the orifice, forming an intermediate chamber between them. When the user uses the reservoir (with its collar) as an applicator, the intermediate chamber makes it possible to regulate the flow of fluid towards the orifice, thereby avoiding any risk of leakage or of loss of fluid.

The spirit of the invention resides in providing the collar with a projecting dome-shaped flange that is used as an applicator. Additionally, it may define a peripheral edge that does not participate in snap-fastening.

BRIEF DESCRIPTION OF THE DRAWINGS

The invention is described more fully below with reference to the accompanying drawings which show an embodiment of the invention by way of non-limiting example.

In the figures.

DETAILED DESCRIPTION

Figure 1:
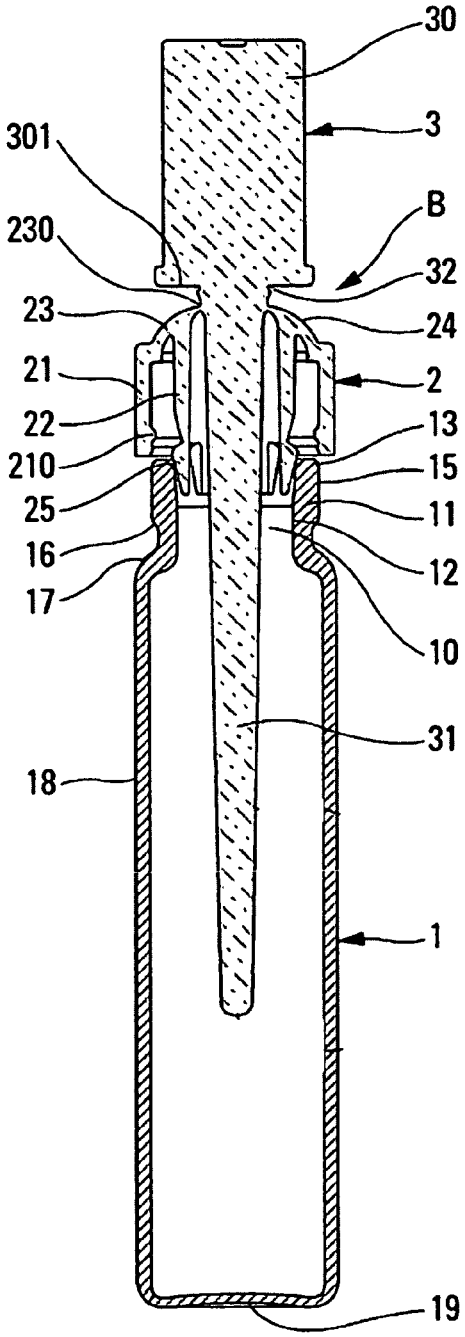
FIG. 1 is a vertical section view through an applicator device of the present invention at the start of the assembly stage.
Figure 2:
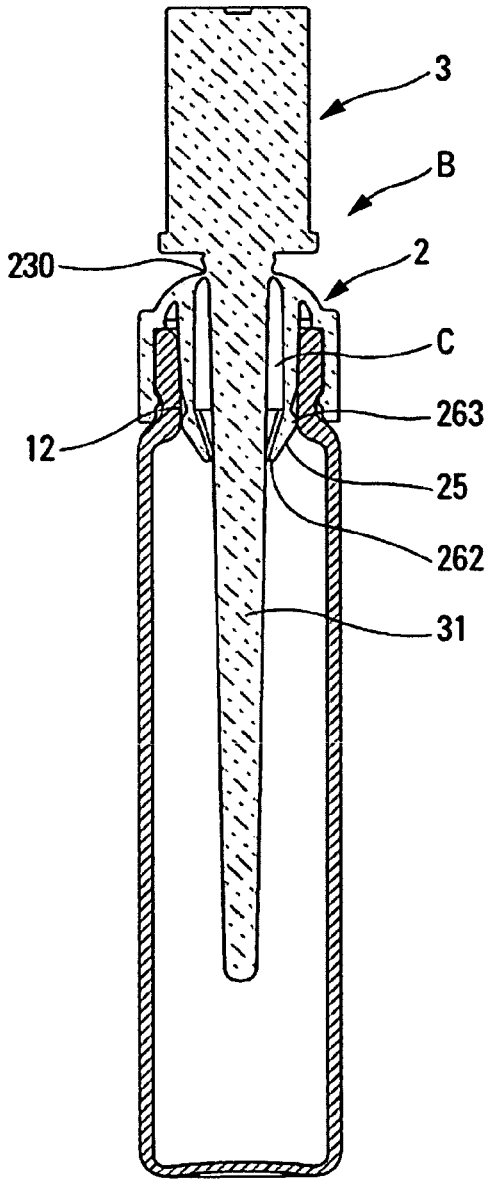
FIG. 2 is a view similar to the view in FIG. 1 in the final assembled position.
Figure 3A:
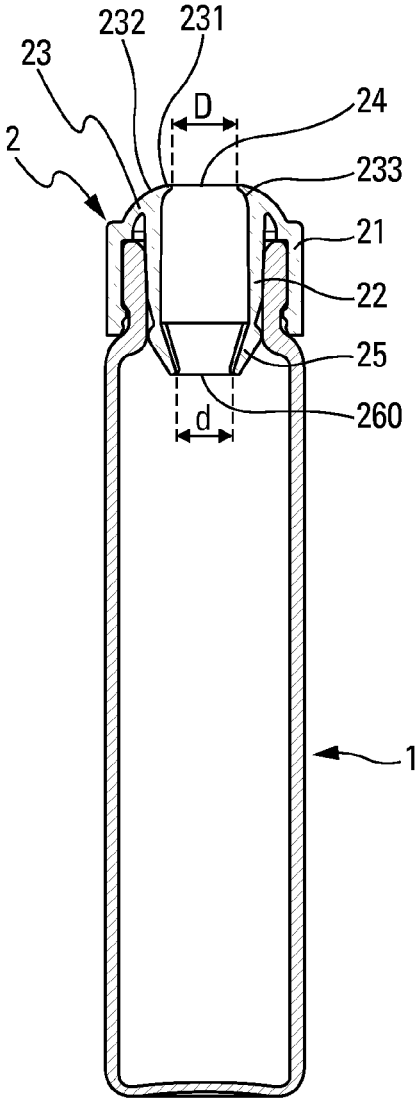
FIGS. 3*a* and 3*b* are views corresponding to a use of the applicator device in FIGS. 1 and 2.
Figure 3B:
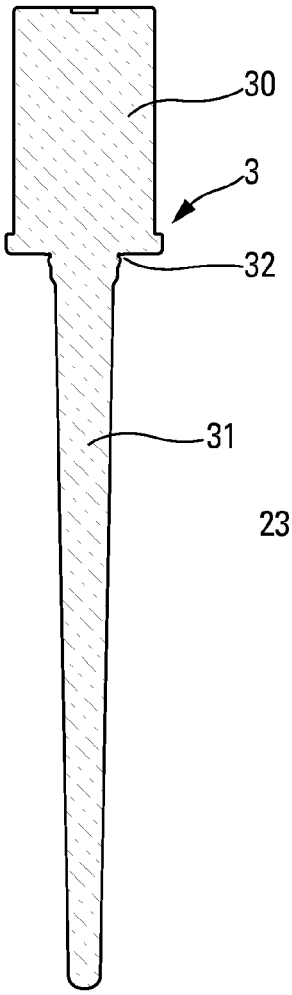

With reference to the figures, the fluid applicator device of the invention comprises a reservoir 1 on which there is mounted a stopper B that comprises a fastener collar 2 and a closure member 3.

The reservoir 1 is for containing fluid, such as a perfume or a lotion. It may be made of glass or of plastics material. The reservoir 1 includes a neck 11 forming an opening 10 for putting the inside of the reservoir into communication with the outside. The neck 11 comprises: an inner wall 12 defining the opening 10 of the neck; a top end 13; and an outer wall 15. A fastener rim 16 is formed on the outer wall 15: the rim 16 is used to fasten the collar 2. Below the rim 16, the neck 11 forms a narrowing prior to widening once again, forming a shoulder 17. Then, the reservoir includes a cylinder 18 that is closed by a bottom wall 19. By way of example, the outer wall of the cylinder 18 may be circularly cylindrical. The capacity of the reservoir is generally of the order of a few milliliters.

As mentioned above, the stopper B comprises two component elements, namely: the fastener collar 2; and the closure member 3.

The fastener collar 2 comprises a fastener ring 21 and a sealing skirt 22 that are connected together at their top ends by an annular flange 23 having an outer wall that forms an outer dome 232. Advantageously, the inner wall also forms an inner dome 233. The two domes are preferably rounded and present a surface that is smooth and continuous. This applies more particularly to the inner dome 233 that does not present any discontinuity or roughness: its surface quality may be improved so as to reduce fluid retention by the capillarity effect or by surface tension. The two domes 232 and 233 converge towards each other towards an annular bridge of material 230 that connects the collar 2 to the closure member 3. Breaking the bridge 230 makes it possible to separate the closure member from the collar, and to create a peripheral edge 231 that defines an orifice 24, as described below. It can thus be said that the wall thickness of the flange 23 decreases or tapers towards the edge 231 or the orifice 24, after the closure member has been separated therefrom. The orifice 24 presents a minimum diameter. In addition, the flange 23 is arranged in such a manner as to come to bear against the top end 13 of the neck. In a non represented alternative, the inner dome may be staged, thus forming for example successive steps of decreasing diameters toward the orifice 24.

The ring 21 extends axially from the outer periphery of the flange 23 and includes a bottom end that is provided with a snap-fastener profile 210 that projects inwards. Thus, when the collar 2 is assembled on the neck 11 of the reservoir 1, the ring 21 is in contact with the outer wall 15, and the snap-fastener profile 210 is thus engaged below the rim 16. Advantageously, the ring 21 extends in alignment with the cylinder 18, thereby advantageously imparting a generally-tubular appearance.

The sealing skirt 22 extends axially downwards from the flange 23. It comes to be housed in the opening of the neck, advantageously in sealing contact with the inner wall 12, so as to avoid any possibility of leakage between the neck and the collar. It should be observed that the inner dome 233 is connected to the skirt 22 without any discontinuity, step, shoulder, or angle, so as to encourage the flow of fluid by gravity. The inner dome 233 makes it possible to pass gently from a diameter of about 3.2 mm or more at the orifice 24 to a diameter of about 4.5 mm or more at its connection to the skirt 22. The inner wall 220 of the skirt 22 flares downwards.

The fastener collar 2 further includes wiper means 25 that are made integrally with the remainder of the collar. In other words, the fastener collar 2 is a single piece of injection-molded plastics material that forms the ring 21, the skirt 22, the flange 23, and the wiper means 25. The wiper means 25 advantageously extend the skirt 22: more precisely, the skirt 22 includes a bottom end 221 to which the wiper means 25 are integrally connected. It should also be considered that the wiper means 25 form an integral part of the skirt 22, which wiper means comprise a top portion for providing sealing with the inner wall 12 of the neck, and a bottom portion that forms the wiper means 25. In a variant, it is also possible to connect the wiper means 25 directly to the flange 23 without forming a sealing skirt 22. It is also possible to connect the wiper means 25 to the flange 23 via an intermediate section that does not necessarily fulfill the function of the sealing skirt 22. The function and the use of the wiper means 25 are described below.

The wiper means 25 may include a plurality of tabs 26 that are connected to the bottom end 221 of the skirt 22. The tabs 26 are separated by slots 27 of longitudinal shape that initially extend axially. The slots 27 open downwards and extend up to the bottom end 221 of the skirt 22. Each tab includes a cam profile 263 that projects radially outwards. The cam profile 263 is situated on the outer face of the tab 26, while its inner face may be cylindrical without forming any particular profile. The tabs 26 are movable radially inwards between an initial position prior to being assembled in the neck, shown in FIG. 1, and a final position after being assembled in the neck, shown in FIGS. 2, 3*a*, 4, and 5. It can easily be observed that the final position, after being assembled in the neck, is obtained by the tabs 26 pivoting inwards about their top ends. The tabs 26 may be substantially rigid and non-deformed, or, in contrast, they may be deformable, locally or in part. Movement between the two positions is determined by the cam profile 263 coming into contact with the inner wall 12 of the neck 11.

In the final assembled position, the bottom free ends 262 of the tabs co-operate with each other to define an optionally continuous wiper ring 260. It can also be said that the slots 27 that separate the tabs 26 are clamped together or closed at their bottom ends.

The closure member 3, preferably made of injection-molded plastics material, comprises a handle 30 and a fluid extractor and applicator element 31.

The handle 30 is for being held by a user while fluid is being applied, and it may present any appropriate shape. In particular, it forms an annular radial abutment wall from which the fluid extractor and applicator element 31 extends.

The extractor and applicator element 31 has the function of making it possible to extract a given quantity of fluid. The element 31 presents a configuration that is generally elongate. The extractor element 31 also has the function of making it easier to put the closure member back into place on the collar. To this end, the element 31 forms a snap-fastener housing 32, advantageously where the element 31 is connected to the handle 30. The snap-fastener housing 32 includes a snap-fastener profile having a projecting snap-fastener bead 321 of shape that is rounded. The bead 321 may be continuous or discontinuous. The snap-fastener profile also includes an inner section 322 that connects the bead 321 to a reception space 320. The space 320 is terminated by the radial abutment wall 301 of the handle 30 that advantageously forms a sealing rim 302 that projects downwards from the abutment wall 301. The snap-fastener profile also includes an outer section 323 that connects the substantially cylindrical section 314 to the bead 321. It can thus be said that the bead 321 is situated between the two sections 322 and 323 and constitutes the tip thereof. Consequently, the snap-fastener housing 32 is formed by the outer section 323, the bead 321, the inner section 322, the reception space 320, and the abutment wall 301 with its optional sealing rim 302. Advantageously, the cylindrical section 314 presents a diameter that is smaller than the diameter of the reception space 320. As a result, the outer section 323 extends radially inwards further than the inner section 322. However, the outer section advantageously forms a ramp that is substantially frustoconical and that forms an angle of less than 45° relative to the axis X.

The cylindrical section 314 advantageously forms the junction zone 313 that connects the closure member 3 to the collar 2 before first use. Below the junction zone 313, the element 31 forms a frustoconical section 312 having a slope that may be similar to the slope of the outer section 323. Below the frustoconical section 312, the element 31 may extend in substantially continuous manner inside the collar 2, with a configuration that tapers a little or that is frustoconical.

The extractor element 31 advantageously extends through the collar 2 and into the reservoir 1. However, it should be observed that the depth to which the element 31 extends may vary greatly. The element 31 need not go beyond the end of the collar 2, or, in contrast, it may come into contact with the bottom wall 19 of the reservoir 1.

The closure member 3 is advantageously made integrally with the collar 2. As shown in the figures, the closure member 3, on being unmolded, is connected via an annular bridge of material 230 to the collar 2. More precisely, the bridge of material 230 connects the junction zone 313 of the element 31 to a peripheral edge 231 formed by the flange 23. This configuration has the advantage of guaranteeing first use, with it not being possible to extract the fluid contained in the reservoir before the bridge of material 230 has been broken.

During first use, the bridge of material must thus be broken. It is broken by a pulling, pushing, or turning movement of the closure member 3 relative to the collar. This has the effect of creating an orifice 24 that is defined by the peripheral edge 231. The closure member 3 may thus be removed freely from the reservoir 1 and from the collar 2. This configuration thus gives rise, in the open position, to a closure member 3 that is compatible with extracting and applying fluid. It should be observed that the orifice 24 is advantageously formed in the center of the flange 23, and that the orifice presents any appropriate shape: circular; oblong; elliptical; etc. The size of the orifice 24 is large enough to prevent the formation of a film or meniscus of fluid that is retained by capillarity. To do this, the orifice 24 advantageously presents a diameter that is greater than about 3.1 mm. In empirical manner, it is found that a film of fluid no longer survives from an orifice diameter of about 3.1 mm fra fluid such as perfume: with this value depending on the adhesion coefficient between the fluid and the material of the surface. An orifice diameter of 3.2 mm certainly guarantees that the film of fluid cannot last.

The peripheral edge 231 results directly from breaking the bridge 230, such that it is not possible to obtain a clean-cut edge. Viewed under a microscope, the edge is in the shape of disorderly projecting and recessed portions in relief, which does not make it possible to create a seal at the edge. In contrast, the outer and inner flange walls 232 and 233 come from molding and as a result present much greater accuracy.

The closure member may be put back into place. To do this, the peripheral edge 231 of the collar 2 may be received in removable or reversible manner in the snap-fastener housing 32. Snap-fastening takes place as a result of the closure member being pressed hard enough for the peripheral edge 231 to pass over the snap-fastener bead 321. Once past the snap-fastener bead, the peripheral edge is received in the reception space 320, with the outer flange wall 232 in sealed bearing contact against the abutment wall 301 (or its rim 302), and the inner flange wall 233 in possibly sealed bearing contact with the inner section 322.

In this position, the peripheral edge 231 is thus in sealing engagement in the snap-fastener housing 32, thereby avoiding any possibility of fluid leaking between the element 31 and the collar 2. It should be observed that the gentle slope of the ramp, formed by the outer section 323 of the snap-fastener profile, and the rounded shape of the bead 323 make it possible to bring the peripheral edge 231 gently into its reception space 320. Snap-fastening and sealing are provided by the flange walls 232 and 233, and not by the edge 231 having quality that is poor because it results from the bridge 230 being broken.

Finally, when it is desired by the user to return to the open position, simple traction exerted on the closure member 3 enables the peripheral edge 231 to pass over the snap-fastener bead 321, thereby enabling the element 31 to be removed.

Figure 4:
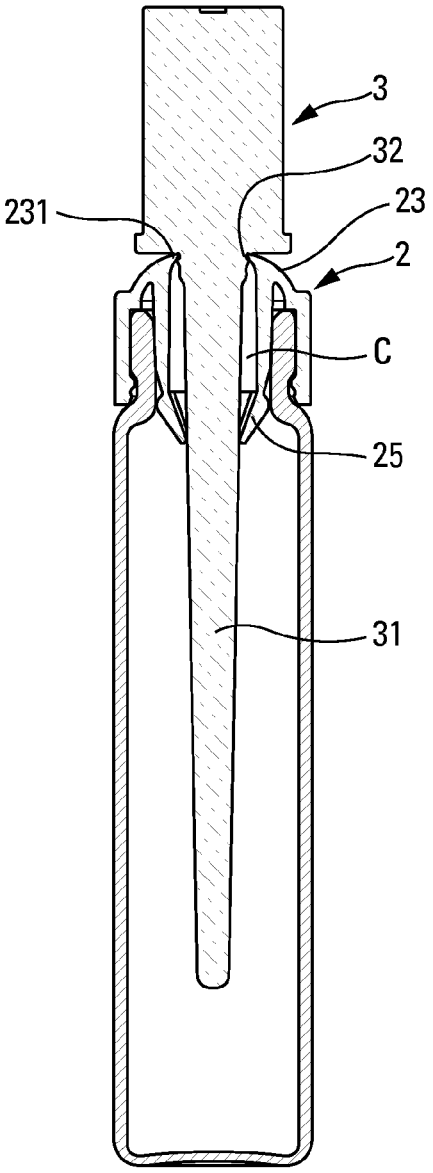
FIG. 4 is a view similar to the view in FIG. 1, in the assembled position.
Figure 6:
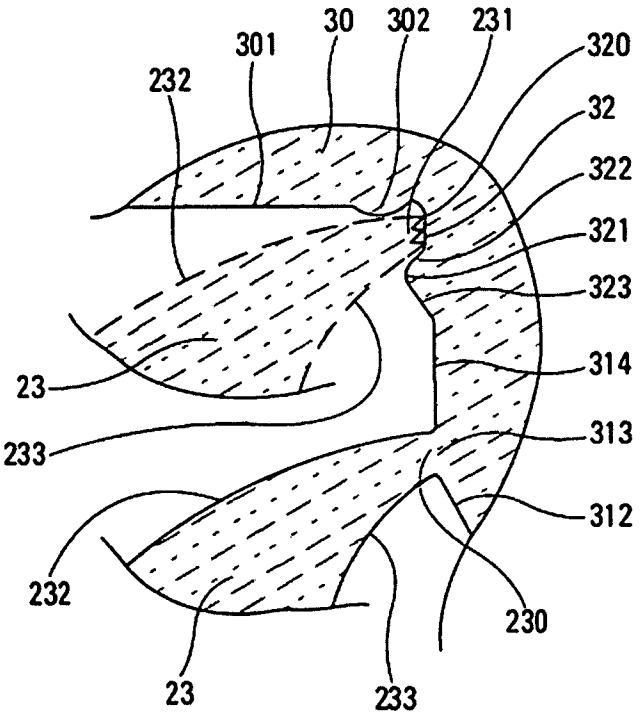
FIG. 6 is a much larger-scale view of a detail of FIGS. 1 and 4.
Figure 5:
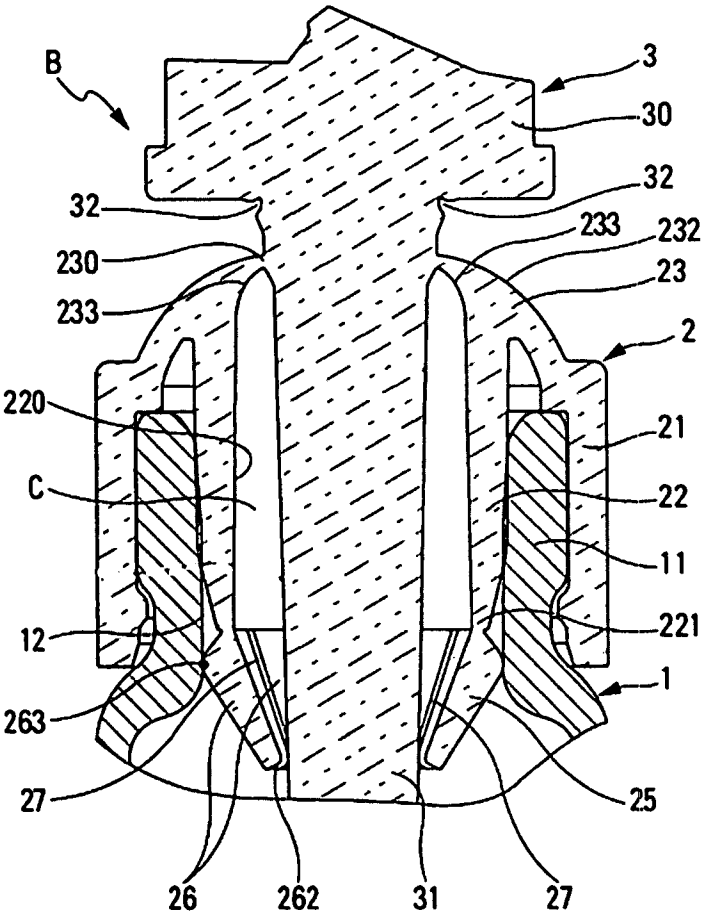
FIG. 5 is a larger-scale view of the upper portion of FIG. 2.

It should also be observed that the element 31 extends through an intermediate chamber C formed by the skirt 22, as can be seen in FIG. 4. The chamber C is thus closed at the peripheral edge 231 that is received in the snap-fastener housing, and its inlet is constricted, particularly at the wiper ring 260. The inlet may thus be limited to the slots 27. When the applicator device is upsidedown or on its side, the chamber C may fill with fluid through the slots 27. When the applicator device is returned to its upright position, the chamber empties its content through the slots 27, because of the surface continuity at the inner dome 233 and at the skirt 22. The concave rounded shape of the dome 233 further encourages the emptying of the chamber C by gravity. Furthermore, the fact that the inner wall 220 of the skirt 22 flares downwards and that the element 31 tapers downwards, this leads to an increase in the offset between the skirt and the element 31, such that the fluid flows that much faster. When the user removes the element 31 from the collar, the chamber C is empty and it is not possible for there to be any phenomenon of interference with the fluid (of the chamber C).

Once the element 31 has been removed from the collar 2, the chamber C communicates with the reservoir 1 through the wiper ring 260 and through the slots 27, and with the outside through the orifice 24. As mentioned above, the diameter of the orifice 24 is greater than 3.1 mm, whereas the diameter of the ring 260 is less than 3 mm. The diameter of the ring 260 may decrease when the element 31 is removed, if provision is made for the tabs 26 of the wiper means to bear in elastic or resilient manner against the element 31. When the reservoir is turned upsidedown, the chamber C is situated below the reservoir. It then fills with fluid: however, the fluid remains inside the chamber C given the surface tension caused by the ring 260, the slots 27, the inner wall 220 of the skirt, the dome 233, and the orifice 24. It is thus possible to use the outer dome 232 of the flange 23 of the collar 2 as a fluid applicator, by putting it into contact with an application surface such as the skin, for example. Not only does the outer dome 232 project with the minimum diameter orifice arranged at the top, but it also provides intuitive information to the user that the dome has an applicator function.

In addition, when the reservoir (with its collar) is returned to its normal position (with the orifice pointing upwards), the inner dome 233, that connects the orifice to the skirt in smooth and continuous manner, makes it possible to empty the chamber C by gravity through the wiper ring 260 and through the slots 27. The fluid has no possibility of being retained by capillarity on the inner dome 233 and on the skirt 22, such that it slides along the inner wall of the chamber C. Sliding is further encouraged by the flared configuration of the skirt 22. The chamber C may thus empty completely. Even a possible film of fluid at the orifice can exist only very temporarily, given the diameter of the orifice that is greater than about 3.1 mm. Thus, the chamber C is completely empty of fluid, and the insertion of the element 31 through the orifice 24 and through the chamber C cannot generate any interference with the fluid, e.g. such as a rise of fluid through the orifice 24, or even spluttering as a result of the film of fluid bursting when it is punctured with the end of the element 31.

By means of the invention, an applicator device is obtained having a collar that may be used as an applicator, having snap-fastening that is improved, having an orifice that prevents any prolonged formation of a film of fluid, and having an intermediate chamber that empties easily by gravity.

The invention claimed is:

1. A fluid applicator device, comprising:

a fluid reservoir (1) including a neck (11) defining an inner wall (12) defining an opening (10); and a stopper (B) comprising a fastener collar (2) and a closure member (3);

the fastener collar (2) being assembled in sealed manner on the neck (11) of the reservoir, the fastener collar (2) defining an orifice (24); and the closure member (3) being capable of closing the orifice (24) of the collar (2), the closure member including a fluid extractor and/or applicator element (31) that extends along an axis (X) through the orifice (24) of the collar (2) and into the reservoir (1);

wherein the fastener collar (2) comprises a top portion forming an annular flange (23) defining a peripheral edge (231) defining the orifice (24), the annular flange (23) including an inner flange wall (233) and an outer flange wall (232) that join together at the peripheral edge (231), the outer flange wall (232) forming an outer dome having a top where the peripheral edge (231) and the orifice (24) are formed, wherein the inner flange wall (233) forms an inner dome having a top where the peripheral edge (231) and the orifice (24) are formed;

wherein the closure member includes a snap-fastener housing that is capable of receiving, in removable manner, the peripheral edge, so as to close the orifice of the collar; and wherein the snap-fastener housing comprises a snap-fastener profile that projects radially outwards, a radial abutment wall, and a reception space that is arranged between the snap-fastener profile and the radial abutment wall, the peripheral edge being received in removable manner in the reception space, with the inner flange wall in contact with the snap-fastener profile and the outer flange wall in contact with the radial abutment wall.

2. An applicator device according to claim 1, wherein the orifice (24) presents a minimum diameter.

3. An applicator device according to claim 1, wherein the inner dome of the inner flange wall (233) is rounded and concave.

4. An applicator device according to claim 1, wherein the inner dome of the inner flange wall (233) is staged.

5. An applicator device according to claim 1, wherein the radial abutment wall (301) forms an annular sealing rim (302) against which the outer flange wall (232) comes into sealing contact, when the peripheral edge (231) is received in the reception space (320).

6. An applicator device according to claim 1, wherein the snap-fastener profile comprises an outer section (323), an inner section (322), and a snap-fastener bead (321) that projects between the outer and inner sections, the outer section (323) connecting the snap-fastener bead (321) to a substantially cylindrical section (314), the reception space (320) presenting a diameter that is greater than the diameter of the substantially cylindrical section (314).

7. An applicator device according to claim 6, wherein the outer section (323) is in the form of a ramp forming an angle of less than 45° relative to the axis X.

8. An applicator device according to claim 1, wherein the peripheral edge (231) of the collar (2) is initially connected via a bridge of material (230) to a junction zone (313) of the extractor and/or applicator element (31).

9. An applicator device according to claim 6, wherein the peripheral edge (231) of the collar (2) is initially connected via a bridge of material (230) to a junction zone (313) of the extractor and/or applicator element (31), which junction zone is formed at the substantially cylindrical section (314), just above a frustoconical section (312).

10. An applicator device according to claim 1, wherein the collar (2) having wiper means (25) formed integrally therewith for wiping the extractor and/or applicator element (31) while it is being removed from the reservoir.

11. An applicator device according to claim 10, wherein the collar (2) includes a sealing skirt (22) that is capable of coming into sealing contact with the inner wall (12) of the neck, the wiper means (25) being formed integrally to extend the skirt (22).

12. A fluid applicator device, comprising:

a fluid reservoir including a neck defining an inner wall defining an opening; and a stopper comprising a fastener collar and a closure member;

the fastener collar being assembled in sealed manner on the neck of the reservoir, the fastener collar defining an orifice; and the closure member being capable of closing the orifice of the fastener collar, the closure member including a fluid extractor and/or applicator element that extends along an axis through the orifice of the fastener collar and into the reservoir;

wherein the fastener collar comprises a top portion forming an annular flange defining a peripheral edge defining the orifice, the annular flange including an inner flange wall and an outer flange wall that join together at the peripheral edge, the outer flange wall forming an outer dome having a top where the peripheral edge and the orifice are formed, wherein the inner flange wall forms an inner dome having a top where the peripheral edge and the orifice are formed; and wherein the inner dome of the inner flange wall is rounded and concave.

13. An applicator device according to claim 12, wherein the closure member (3) includes a snap-fastener housing (32) that is capable of receiving, in removable manner, the peripheral edge (231), so as to close the orifice (24) of the collar (2).

14. An applicator device according to claim 13, wherein the snap-fastener housing (32) comprises a snap-fastener profile (321, 322, 323) that projects radially outwards, a radial abutment wall (301), and a reception space (320) that is arranged between the snap-fastener profile and the radial abutment wall, the peripheral edge (231) being received in removable manner in the reception space (320), with the inner flange wall (233) in contact with the snap-fastener profile (321, 322, 323) and the outer flange wall (232) in contact with the radial abutment wall (301).

15. The applicator device according to claim 12, wherein the orifice presents a minimum diameter.

16. The applicator device according to claim 12, wherein the inner dome of the inner flange wall is staged.

17. The applicator device according to claim 12, wherein a distal end of the inner flange wall ends at the top of the inner dome.

* * * * *